United States Patent [19]

Woolston et al.

[11] 4,283,185

[45] Aug. 11, 1981

[54] STACKER CONVEYOR RUN SEPARATION CONTROL

[75] Inventors: A. Brent Woolston, Palmyra; Donald J. Evans, Cherry Hill, both of N.J.

[73] Assignee: Molins Machine Company, Inc., Cherry Hill, N.J.

[21] Appl. No.: 82,846

[22] Filed: Oct. 9, 1979

[51] Int. Cl.[3] ..... B31B 1/16

[52] U.S. Cl. ..... 493/15; 493/17; 493/22; 493/35; 493/342; 493/362

[58] Field of Search ..... 93/58.3, 58 R, 58.2 R, 93/93 DP, 93 C, 93 R; 271/202, 199, 259, 256, 258, 270; 83/93, 86, 88, 94, 152, 155, 358; 493/13-19, 22, 35, 342, 362

[56] References Cited

U.S. PATENT DOCUMENTS

| | | | |
|---|---|---|---|
| 2,485,952 | 10/1949 | Apgar et al. | 198/20 |
| 3,166,312 | 1/1965 | Rehm | 271/32 |
| 3,178,174 | 4/1965 | Schneider | 271/46 |
| 3,287,015 | 11/1966 | Preuss et al. | 271/259 |
| 3,315,956 | 4/1967 | Lyman | 271/46 |
| 3,507,489 | 4/1970 | Wilshin et al. | 271/46 |
| 3,542,362 | 11/1970 | Brockmuller et al. | 271/75 |
| 3,565,423 | 2/1971 | Kluth | 271/76 |
| 3,659,839 | 5/1972 | Baucke | 271/46 |
| 3,724,840 | 4/1973 | Kuckhermann | 271/46 |
| 3,727,911 | 4/1973 | Vits | 271/71 |
| 3,752,043 | 8/1973 | Rapparlie et al. | 93/93 DP |
| 3,791,269 | 2/1974 | Sawada | 93/93 DP |
| 3,802,699 | 4/1974 | Wiig et al. | 271/64 |
| 3,880,420 | 4/1975 | Martin | 271/184 |
| 3,945,635 | 2/1976 | Marin | 271/202 |
| 3,981,493 | 9/1976 | Klappenecker et al. | 271/259 X |
| 4,099,712 | 7/1978 | Martin | 271/184 |
| 4,111,411 | 9/1978 | Graves et al. | 271/199 |
| 4,200,276 | 4/1980 | Marschke | 271/202 X |

*Primary Examiner*—James F. Coan

*Attorney, Agent, or Firm*—Seidel, Gonda, Goldhammer & Panitch

[57] ABSTRACT

Box blanks produced from a moving web by a paperboard corrugator are shingled on a stacker conveyor. The corrugator includes a shear which severs the web in response to a production run change signal into leading and trailing portions. A cut-off machine cuts the severed web portions into the box blanks. Box blanks cut from the leading portion of the severed web are part of the old production run. Box blanks cut from the trailing portion of the severed web are part of the new production run. The leading edge of the trailing portion of the severed web is tracked to the cut-off machine. The trailing edge of the first full size box blank of the new production run is detected at a first position relative to the stacker conveyor. The trailing edge of the first full size box blank is then tracked to a second position on the stacker conveyor. When the trailing edge of the first full size box blank reaches the second position, a command signal is generated. In response to the command signal, a retarding means retards movement, e.g., reduces speed, of the first full size box blank of the new production run on the stacker conveyor so that a separation is created between the old and new production runs on the stacker conveyor.

10 Claims, 3 Drawing Figures

STACKER CONVEYOR RUN SEPARATION CONTROL

BACKGROUND OF THE INVENTION

The present invention is directed to a production run separation control for a stacker conveyor. In particular, the invention is directed to a control for creating a separation between the box blanks of an old production run and the box blanks of a succeeding or new production run on the stacker conveyor. This is accomplished by automatically retarding the movement of the first full size box blank of the new production run on the stacker conveyor as the box blanks of the old production run are cleared by the stacker conveyor.

Various techniques are known for clearing the box blanks of an old production run off a conveyor. For example, in U.S. Pat. No. 3,791,269, a sheet delivery device includes a counter which counts the number of sheets in a production run. When a predetermined count is reached, denoting the end of the production run, the counter activates a piston to lower a conveyor with respect to a bank of suction devices. The devices hold the first sheets of the new production run while the old run is cleared on the conveyor.

Similarly, in U.S. Pat. No. 3,880,420, the speed of a corrugator is related by a predetermined ratio to the speeds of a side take-off conveyor, a transfer conveyor and stacker conveyor. A change in speed of the side take-off, transfer and stacker conveyors owing to a change of the corrugator speed during an order change-over is delayed to permit the clearing of all old order sheets on the side take-off conveyor. The delay is effected by electrical or pneumatic means.

A further example is shown in U.S. Pat. No. 3,178,174 in which a suction chamber is provided at the inlet of a shingling conveyor belt to pull down the rear end of a sheet to separate it from a following sheet.

A gap type corrugator is disclosed in copending U.S. patent application Ser. No. 903,350 entitled Continuous Running Corrugator, filed May 5, 1978 and assigned to the assignee of the instant application. That application describes a method of creating a gap in the severed web to provide an interval for the slitter-scorer and cut-off machines to be readjusted for the next production run. In contrast to this gap type corrugator, the instant application is directed to a method of and apparatus for separating the sheets from two production runs without varying the speed of the cut-off machine.

There is presently a need in the industry for an order separation control which automatically creates the separation between old and new production runs on the stacker conveyor by tracking the edges of the web severed during a change-over in production runs.

BRIEF SUMMARY OF THE INVENTION

The first full size box blank of a new production run is separated from the box blanks of an old production run on a stacker conveyor. The box blanks are cut by a cut-off machine from a moving web which is severed into leading and trailing portions by a single cut shear. The leading edge of the trailing portion of the severed web is detected at the cut-off machine. The trailing edge of the first full size box blank cut from the trailing portion of the web is detected at a first position relative to the stacker conveyor. The trailing edge of the first full size box blank is then detected at a second position on the stacker conveyor. The second position may be located at the entrance of the stacker conveyor. Movement of the first full size box blank on the stacker conveyor is retarded in response to detection of the trailing edge of the first box blank at the first and second positions.

An advantage of the invention is that the box blanks of new and old production runs are automatically separated at the stacker conveyor.

Another advantage of the invention is that the box blanks of the new and old production runs are separated as the first full size box blank of the new production run appears at the stacker conveyor.

A further advantage of the invention is that the separation of the box blanks of the new and old production runs on the stacker conveyor is effected by a reliable and accurate position tracking technique.

A further advantage of the invention is that it can be implemented for use in a conventional corrugator.

Further advantages appear hereinafter.

BRIEF DESCRIPTION OF THE DRAWINGS

For the purpose of illustrating the invention, there is shown in the drawings a form which is presently preferred; it being understood, however, that this invention, is not limited to the precise arrangements and instrumentalities shown.

DETAILED DESCRIPTION OF THE INVENTION

Figure 1:
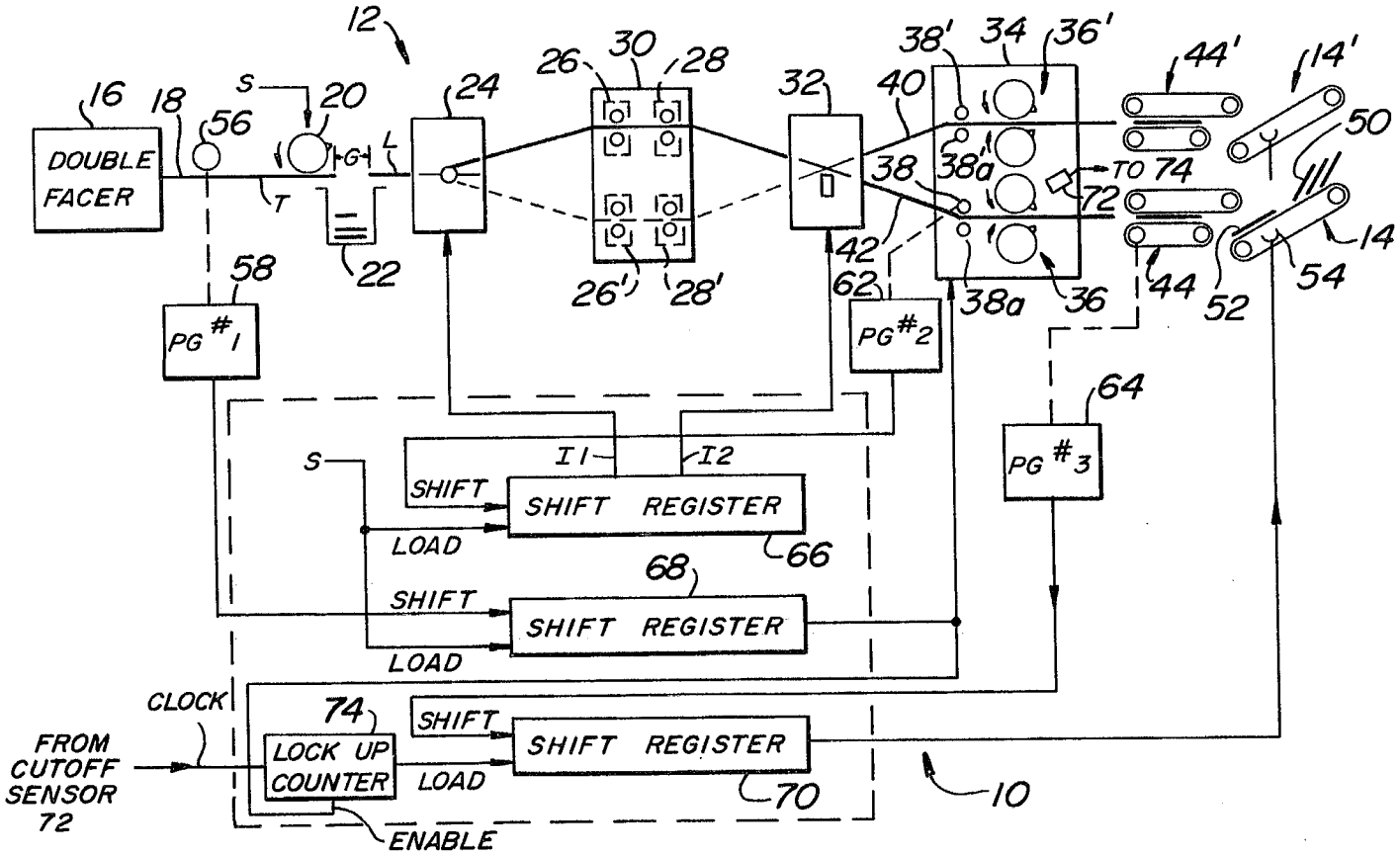
FIG. 1 is a block diagram of the run separation control of the present invention.

Referring to the drawings, wherein like numerals indicate like elements, there is shown in FIG. 1 an order separation control 10 for a corrugator 12 including stacker conveyors 14, 14'.

The corrugator 12 includes a web producing machine 16, such as a double facer machine, which produces a continuous moving web 18 of double faced corrugated paperboard. The invention herein, however, is not limited by the particular type of web produced by the web producing machine 16. The moving web 18 moves through a rotary shear 20 over a hopper 22 to a web diverter machine 24. The hopper 22 collects scrap which may be cut from web 18 by shear 20. The web diverter 24 guides the moving web 18 either to the scorer heads 26 and the slitter heads 28 of a slitter-scorer machine 30 or to the scorer heads 26' and slitter heads 28' of the slitter-scorer machine (as indicated by broken lines in FIG. 1). At the slitter-scorer machine 30, the scorer heads 26 score the web 18 and the slitter heads 28 slit and trim the web longitudinally at preselected locations to provide one or more moving webs. The scored and slit webs advance to a slat table 32 which separates the webs along the slit into webs 40 and 42 for simultaneous processing into box blanks of preselected lengths by a cut-off machine 34.

The cut-off machine 34 includes pairs of upper and lower rotary cut-off knives 36' and 36 respectively. A driven pull roll 38 is associated with cut-off knives 36. A driven pull roll 38' is associated with cut-off knives 36'. Cooperating with each driven pull roll are idler rolls **38*a* and 38*a*' which hold the web in contact with the driven pull rolls. The pull rolls pull the separated webs 40 and 42 to the respective cut-off knives 36, 36'. The cut-off knives 36 and 36' are adjusted to cut the webs 40, 42 respectively into box blanks of preselected lengths. The knives 36, 36' can be adjusted as desired to cut different or identical lengths of box blanks from the webs 40, 42**.

Figure 2:
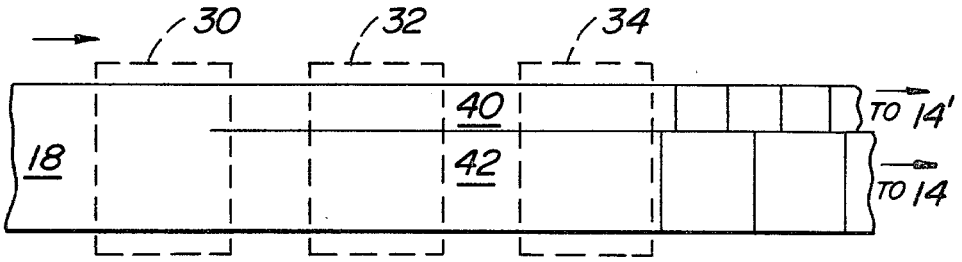
FIG. 2 is a plan view of a moving web as it is slit and cut into box blanks by a corrugator.

The box blanks produced by cut-off knives 36 are transported by a cut-off conveyor 44 to the stacker conveyor 14. The box blanks produced by cut-off knives 36' are transported by cut-off conveyor 44' to stacker conveyor 14'. A plan view of the webs 18, 40 and 42 and the box blanks produced by the cut-off machine 34 is shown in FIG. 2. The box blanks are deposited on stacker conveyors 14, 14' in shingled relation by the difference in speeds between the cut-off conveyors 44, 44' and their associated stacker conveyors 14, 14' respectively. Thus, each stacker conveyor 14, 14' is run at a speed slower than the speed of its associated cut-off conveyor 44, 44' to obtain the desired shingling relation between the box blanks deposited on the stacker conveyor. The shingle ratio between box blanks on each stacker conveyor is determined by the ratio of the speed of the stacker conveyor 14, 14' to the speed of the associated cut-off conveyor 44, 44'.

In the corrugator 12 shown in FIG. 1, the scorer and slitter heads 26, 28 in the slitter-scorer machine 30, the driven pull roll 38*a* in the cut-off machine 34, and the cut-off conveyor 44 are driven at speeds proportional to the speed of the double facer machine in a conventional manner. Thus, the scorer and slitter heads 26, 28, the pull roll 38*a*, and the cut-off conveyor 44 may be driven directly by associated dc motor drives or indirectly through appropriate gearing coupled to the double facer drive shaft (not shown). Similarly, the stacker conveyor 14 is driven at a speed proportional to the speed of the double facer drive shaft, either directly by an associated dc motor drive or indirectly through appropriate gearing coupled to the double facer drive shaft.

For ease of explanation, the run separation control 10 is shown in operative association with the scorer and slitter heads 26, 28, pull roll 38, cut-off knives 36, cut-off conveyor 44 and stacker conveyor 14. It is understood, however, that an identical run separation control may be associated with the scorer and slitter heads 26', 28', pull roll 38', cut-off knives 36', cut-off conveyor 44' and stacker conveyor 14'.

Typically, shear 20 is approximately located 40 feet from cut-off conveyor 44, and cut-off knives 36 are between 5 and 8 feet from the inlet of the cut-off conveyor. During a production run, the moving web 18 is fed past the shear 20, through the web diverter machine 24, through the slitter scorer machine 30 and the slat table 32. At the slat table 32, the production run is separated into two webs 40, 42 for processing by the cut-off machine 34. The web 42 is pulled by pull roll 38*a* toward cut-off knives 36 which cut the web into box blanks of preselected lengths. The box blanks are transported by the cut-off conveyor 44 to the stacker conveyor 14 where they are transported in shingled relation. Preferably, the slitter-scorer machine 30 is driven at 2% over line speed. By line speed is meant the nominal speed at which the web 18 issues from the double facer machine. The pull roll 38 is driven at 4% over line speed, and the cut-off conveyor is driven at 6% over line speed. As a result, during a production run, there is slippage between the web 18 and the heads 26, 28 of the slitter-scorer machine 30, the pull roll 38 of the cut-off machine 34, and the cut-off conveyor 44.

When a new production run is ordered, a production run change signal S is generated either manually or automatically. The run change signal S causes the shear 20 to sever the web 18 into a leading portion L and a trailing portion T. Box blanks of the old production run are cut from the leading portion L of the severed web. Box blanks of the new production run are cut from the trailing portion T of the severed web. Owing to the overspeed of the slitter-scorer machine 30 and the pull roll 38, the leading portion L of the severed web is accelerated towards the cut-off conveyor 44 while the trailing portion T of the severed web continues to move at nominal line speed. Accordingly, a gap G is created between the leading portion L and the trailing portion T of the severed web. The gap tends to increase in size as the web portions move through the corrugator 12.

If the size of the gap G exceeds an upper limit, say 15 inches or more for the distances and speeds given above, the first full size blank cut from the trailing portion T of the severed web (the first blank of the new production run) will strike the sheets on the stacker conveyor and butt up or bump against the last blank cut from the leading portion L of the severed web (the last blank of the old production run). The first blank will displace the last old blank on the stacker conveyor without shingling. To avoid bumping of the first new and last old blanks, the size of the gap G must be controlled so that it does not exceed the upper limit. A web gap control for controlling the size of the gap G in this manner to avoid bumping is disclosed in co-pending patent application Ser. No. 082,268 entitled "Web Gap Control For Corrugator" assigned to the assignee herein and incorporated herein by reference.

In the following description of the invention, it is presumed that the gap G between the leading and trailing portions of the severed web is of such a size that the last blank of the old production run, designated 50 in FIG. 1, and the first blank of the new production run, designated 52, are received in the desired shingled relation on stacker conveyor 14 without bumping. It is therefore necessary to separate blanks 50 and 52, that is, to separate the box blanks of the old and new production runs on the stacker conveyor itself.

In changing from one production run to another, the signal S is generated to actuate the shear 20. The shear 20 severs the web 18 into the leading portion L and the trailing portion T. Box blanks for the old production run are cut from the leading portion L of the severed web. Box blanks for the new production run are cut from the trailing portion T of the severed web. A measuring roll or encoder 56 and pulse generator 58 provide a speed signal representative of the speed of the web 18 issuing from the double facer machine 16. The signal produced by pulse generator 58 is a stream of pulses whose frequency varies with the speed of the web 18. As described hereinafter, the output of pulse generator 58 is used in tracking the leading edge of the trailing portion T of the severed web as it moves through the corrugator 12.

The speed of the leading portion L of the severed web is sensed by a pulse generator 62, coupled mechanically to idler roll 38 at cut-off machine 34. The output of the pulse generator 62 is a stream of pulses whose frequency varies with the speed of the leading portion L of the severed web as it moves through the corrugator 12. As described hereinafter, the output of the pulse generator 62 is used in tracking the position of the trailing edge of the leading portion L of the severed web up to the cut-off machine 34.

The speed of the box blanks transported by the cut-off conveyor 44 to the stacker conveyor 14 is sensed by a pulse generator 64 coupled mechanically to the driven shaft of the cut-off conveyor 44. The output of the pulse generator 64 is a stream of pulses whose frequency varies with the speed of the cut-off conveyor. As described hereinafter, the output of the pulse generator 64 is used in tracking the position of the trailing edge of the first full size box blank cut from the trailing portion T of the severed web by the cut-off machine 34. This box blank is the first box blank of the new production run.

In operation, the production run change signal S loads a bit into shift registers 66 and 68 whereupon the shear 20 is actuated to sever the moving web 18 into the leading and trailing portions L and T. The bit loaded into shift register 66 is shifted through the register at the frequency of the pulse output of pulse generator 62. Thus, the bit is shifted through the shift register 66 at a rate proportional to the speed of the leading portion L of the severed web. The "length" of the shift register 66, i.e., the number of stages of the shift register, is such that the bit will be shifted to the output of the shift register when the trailing edge of the leading portion L of the severed web traverses the web distance between the shear 20 and the pull roll 38 of the cut-off machine 34.

The shift register 66 is used to control the operation of the web diverter machine 24 and the slat table 32 for processing the trailing portion T of the severed web, that is, for processing the new production run. For this purpose, a control (not shown) in the web diverter machine 24 is operated by the output of an intermediate stage I1 of the shift register 66. The stage I1 of the shift register 66 is chosen so that the output of the stage operates the web diverter machine control when the bit loaded into the shift register 66 enters that stage. This coincides with the passage of the trailing edge of the leading portion L of the severed web through the web diverter machine. The web diverter machine is then prepared to receive and direct the trailing portion T of the severed web to heads 26', 28' of slitter-scorer machine 30.

Similarly, a control (not shown) in the slat table 32 is actuated by the output of stage I2 of the shift register 66 when the bit loaded into the shift register enters that stage. This coincides with the passage of the trailing edge of the leading portion L of the severed web through the slat table 32. When the control is actuated, the control adjusts the slat table 32 so that the table can receive the following trailing portion T of the severed web via the scorer and slitter heads 26', 28' of the slitter-scorer machine 30.

Shift register 68 tracks the position of the leading edge of the trailing portion T of the severed web between the shear 20 and the idler roll 38 of the cut-off machine 34. The bit loaded into the shift register 68 is shifted through the shift register at a rate proportional to the speed of the trailing portion T of the severed web through the corrugator 12. The "length" of the shift register 68 is chosen to match the web distance from the shear 20 to the idler roll 38 of the cut-off machine 34. When the bit loaded into the shift register 68 is shifted to the output of the shift register, the leading edge of the trailing portion T of the severed web is at the entrance to the pull roll 38. The output of shift register 68 serves as a change of length command signal which actuates an electro-mechanical control (not shown) in the cut-off machine 34. This control causes the knives 36 to cut box blanks of a new preselected length from the trailing portion T of the severed web. When the change of length command signal is received by the cut-off machine, the knives 36 cut the trailing portion T of the web by completing the cut in progress for the old production run length and then by making a second cut of the trailing portion T for the new production run length.

Figure 3:
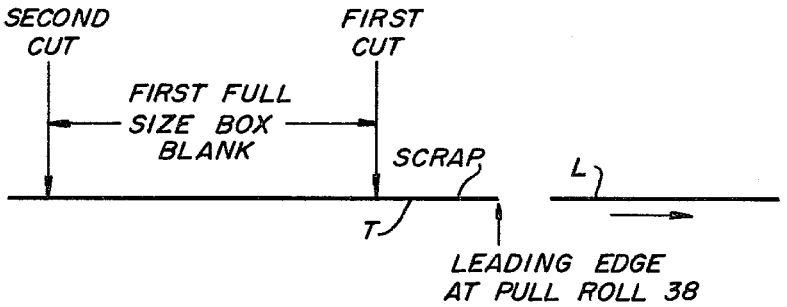
FIG. 3 is a diagram of the sequence of cuts made in the trailing portion of the severed web to produce the first full size box blank of a new production run.

When the leading edge of the trailing portion T is at pull roll 38, the output of shift register 68 enables a lock-up counter 74 to begin counting. The counter 74 counts pulses generated by sensor 72. Sensor 72 is a magnetic pick-up which generates an output signal for each cut made by cut-off knives 36. When the cut-off knives 36 make the first cut of the trailing portion T of the severed web following detection of the leading edge of web portion T at pull roll 38, the board cut from web portion T will be scrap and the counter 74 will count to one. See FIG. 3.

Following the first cut of the trailing portion T of the severed web, however, the cut-off knives 36 will cut box blanks of the desired lengths (for the new production run) from the trailing portion T of the severed web. Thus, the second cut of trailing web portion T produces the first full size box blank of the new production run. When cut-off knives 36 make the second cut, the counter 74 counts to two in response to the output of sensor 72. The output of lock-up counter 74 thereupon changes to load a bit into shift register 70 and the counter stops counting. The bit is then shifted through the shift register by the pulse output of pulse generator 64. Accordingly, the bit is shifted through the shift register at a rate proportional to the speed at which the first full size box blank is transported by the cut-off conveyor 44 to the stacker conveyor 14. The "length" of the shift register 70 is chosen to match the distance of travel of a box blank from the cut-off machine 34 to the suction cups 54 of the stacker conveyor. See FIG. 1. Thus, the bit loaded into shift register 70 will appear at the output of the shift register when the trailing edge of the first full size box blank 52 of the new production run appears at the stacker conveyor 14.

At this time, the output of the shift register 70 actuates the suction cups 54, and the suction cups grasp the tail of the first full size box blank 52 to retain the box blank in position as the stacker conveyor clears the box blanks of the old production run, ending with box blank 50, from the stacker conveyor.

In this manner, the new and old production runs are separated at the stacker conveyor after reception of the first full size box blank 52 of the new production run at the stacker conveyor. Of course, suction is eventually removed from the cups 54 to free the box blank 52 so that the stacker conveyor can transport the box blanks of the new production run to the delivery end of the system. Removal of the suction to the cups 54 may be accomplished in any suitable manner upon clearance of the old production run from the stacker conveyor. For example, appropriate logic circuitry, such as an exclusive OR circuit, can be provided to operate the suction cups to retain the box blank 52 in position in response to the output of shift register 70 and to remove suction from the cups in response to a signal generated by a limit switch or similar sensor which indicates passage of the last blank 50 at a particular position on the stacker conveyor 14.

Although creation of the separation between the new and old production runs at the stacker conveyor 14 has been described in terms of operation of suction cups 54 which stop the first blank 52 of the new production run at the stacker conveyor, it should be appreciated that other retarding means may be employed at the stacker conveyor to retard movement of the blank 52 with respect to the blanks of the old production run. For example, snubbing wheels or brushes may be used to retard the movement of blank 52 at the stacker conveyor in response to the output of the shift register 70.

Further, although the invention has been described in terms of certain logic circuitry and shift registers, it should be appreciated that equivalent functions can be performed by programmed microcomputers and appropriate interface circuitry to track the web and box blanks in the same manner and for the same purposes described herein, all within the spirit and scope of the invention.

The present invention may be embodied in other specific forms without departing from the spirit or essential attributes thereof and, accordingly, reference should be made to the appended claims, rather than to the foregoing specification, as indicating the scope of the invention.

We claim:

1. A method of creating a separation between box blanks transported on a stacker conveyor wherein said box blanks are cut by a cut-off machine from a moving web previously severed into leading and trailing portions, comprising:

detecting the leading edge of said trailing portion of said severed web at said cut-off machine, detecting the trailing edge of the first box blank cut from said trailing portion of said severed web at a first position relative to said stacker conveyor, detecting the trailing edge of said first box blank at a second position on said stacker conveyor, and retarding movement of said first box blank relative to said stacker conveyor in response to said detecting steps.

2. The method according to claim 1 wherein said step of retarding movement of said first box blank includes stopping said box blank on said stacker conveyor.

3. The method according to claim 2 wherein said step of stopping said first box blank includes retaining said first box blank in a stationary position by means of suction.

4. A method of creating a separation between box blanks transported on a stacker conveyor wherein said box blanks are cut by a cut-off machine from a moving web previously severed into leading and trailing portions, comprising:

tracking the position of the leading edge of said trailing portion of said severed web to said cut-off machine, tracking the position of the trailing edge of a first box blank cut from said trailing portion of said severed web between said cut-off machine and said stacker conveyor, and retarding movement of said first box blank relative to said stacker conveyor when said trailing edge of said first box blank reaches said stacker conveyor.

5. The method according to claim 4 wherein said step of retarding movement of said first box blank includes stopping said first box blank on said stacker conveyor.

6. The method according to claim 5 wherein said step of stopping said first box blank includes retaining said first box blank in a stationary position by means of suction.

7. A run separation control for a stacker conveyor which transports box blanks produced from a moving web by a corrugator including a shear which severs the web into leading and trailing portions and a cut-off machine provided with knife means which cut the web into box blanks, said stacker conveyor including retarding means for retarding movement of a box blank on said stacker conveyor in response to a command signal, comprising:

means for detecting the leading edge of said trailing portion of said severed web at said cut-off machine, means for detecting the trailing edge of a first box blank cut from said trailing portion of said severed web at a first position relative to said stacker conveyor, means for detecting the trailing edge of said first box blank at a second position on said stacker conveyor, means for generating said command signal when said trailing edge of said first box blank reaches said second position on said stacker conveyor, whereby said retarding means retards movement of said first box blank realtive to said stacker conveyor in response to said command signal.

8. The run separation control according to claim 7 wherein said means for detecting said trailing edge of said first box blank at said first position relative to said stacker conveyor includes means for counting the number of cuts made by said knife means and wherein said means for detecting the trailing edge of said first box blank at said second position on said stacker conveyor includes means for tracking the position of the trailing edge of said first box blank between said cutoff machine and said stacker conveyor.

9. A run separation control for a stacker conveyor which transports box blanks produced from a moving web by a corrugator including a shear which severs the web into leading and trailing portions and a cut-off machine provided with knife means which cut the severed web into box blanks, said stacker conveyor including retarding means for retarding movement of a box blank on said stacker conveyor in response to a command signal, comprising:

means for tracking the position of the leading edge of said trailing portion of said severed web between said shear and said cut-off machine, means for tracking the position of the trailing edge of a first box blank produced by said cut-off machine from said trailing portion of said severed web between said cut-off machine and said stacker conveyor and for generating said command signal when said trailing edge of said first box blank cut from said trailing portion of said severed web reaches said stacker conveyor, whereby said retarding means retards movement of said box blank cut from said trailing portion of said severed web in response to said command signal.

10. The run separation control according to claim 9 wherein said means for tracking the position of said leading edge of said trailing portion of said severed web includes a first shift register and a first pulse generator for clocking said first shift register with a pulse train having a variable frequency based on the rate of movement of said trailing portion of said severed web and wherein said means for tracking the position of said trailing edge of said first box blank produced by said cut-off machine from said trailing portion of said severed web includes means for counting the number of cuts made by said knife means and a second shift register and a second pulse generator for clocking said second shift register with a pulse train having a variable frequency based on the rate of movement of said first box blank between said cut-off machine and said stacker conveyor.

* * * * *